US009151006B2

(12) United States Patent
Guggino et al.

(10) Patent No.: US 9,151,006 B2
(45) Date of Patent: Oct. 6, 2015

(54) MATERIAL PUSHER WITH CONTROL SYSTEM

(71) Applicant: Pro-Tech Manufacturing and Distribution, Inc., Rochester, NY (US)

(72) Inventors: Michael J. Guggino, Bloomfield, NY (US); Barry Sherman, Dansville, NY (US); James Maier, Ontario, NY (US); Tom Moran, Hemlock, NY (US); Samuel Granados, Arvada, CO (US); Thomas B. Maier, Oakfield, NY (US); Dale Keep, Walla Walla, WA (US)

(73) Assignee: Pro-Tech Manufacturing and Distribution, Inc., Rochester, NY (US)

( * ) Notice: Subject to any disclaimer, the term of this patent is extended or adjusted under 35 U.S.C. 154(b) by 231 days.

(21) Appl. No.: 13/761,347

(22) Filed: Feb. 7, 2013

(65) Prior Publication Data

US 2013/0212912 A1 Aug. 22, 2013

Related U.S. Application Data

(60) Provisional application No. 61/596,773, filed on Feb. 9, 2012, provisional application No. 61/624,640, filed on Apr. 16, 2012, provisional application No. 61/661,629, filed on Jun. 19, 2012.

(51) Int. Cl.
*E01H 5/06* (2006.01)

(52) U.S. Cl.
CPC ..... *E01H 5/061* (2013.01)

(58) Field of Classification Search
USPC ..... 37/231, 234, 214–218, 233, 266, 37/270–284; 172/810–832
See application file for complete search history.

(56) References Cited

U.S. PATENT DOCUMENTS

| | | | |
|---|---|---|---|
| 520,479 | A | 5/1894 | Bunnell |
| 634,578 | A | 10/1899 | Kaucher |
| 637,712 | A | 11/1899 | Damerell |
| 842,704 | A | 1/1907 | Robins |

(Continued)

FOREIGN PATENT DOCUMENTS

| | | |
|---|---|---|
| CA | 2126408 | 3/2000 |
| CA | 2566993 | 10/2012 |

(Continued)

OTHER PUBLICATIONS

Blaw-Knox Asphalt Pavers leaflet; 1 page; c. 1996; Blaw-Knox Construction Equipment Corporation.

(Continued)

*Primary Examiner* — Matthew D Troutman
(74) *Attorney, Agent, or Firm* — Duane C. Basch; Basch & Nickerson LLP

(57) ABSTRACT

A material pushing apparatus is disclosed that has a central blade, at least one removable side plate attached to the central blade and a segmented scraping edge flexibly attached to the central blade along the bottom longitudinal edge of the blade. A position sensor is attached between the blade and the scraping edge and produces a position signal that is displayed to indicate the relative position between the blade and edge in order to characterize the amount of downward pressure applied to the scraping edge. Other aspects and features of the disclosed apparatus include a tilt sensor and display, and an improved coupler having shock-absorbing features and a cam-type clamping arrangement.

19 Claims, 10 Drawing Sheets

(56) References Cited

U.S. PATENT DOCUMENTS

| | | | |
|---|---|---|---|
| 1,373,799 | A | 4/1921 | Conley |
| 1,528,141 | A | 3/1925 | Arndt |
| 1,581,414 | A | 4/1926 | Young |
| 2,061,585 | A | 11/1936 | Meyer |
| 2,078,636 | A | 4/1937 | Kuchar |
| 2,092,990 | A | 9/1937 | Southwick |
| 2,320,723 | A | 6/1943 | Gaylord |
| 2,393,432 | A | 1/1946 | Turner |
| 2,445,140 | A | 7/1948 | Hanington |
| 2,515,384 | A | 7/1950 | Von Carnop |
| 2,552,426 | A | 5/1951 | Hedley |
| 2,577,977 | A | 12/1951 | Nelson |
| 2,723,471 | A | 11/1955 | Trundle |
| 2,732,638 | A | 1/1956 | Leufvenius |
| 2,763,944 | A | 9/1956 | Magee |
| 2,841,897 | A | 7/1958 | Duke |
| 2,882,620 | A | 4/1959 | MacDonald |
| 3,130,843 | A | 4/1964 | Kelly |
| 3,149,679 | A | 9/1964 | Johnson et al. |
| 3,189,203 | A | 6/1965 | Brocklebank et al. |
| 3,312,002 | A | 4/1967 | Benetti |
| 3,391,478 | A | 7/1968 | Astill |
| 3,398,472 | A | 8/1968 | Leijon |
| 3,413,738 | A | 12/1968 | Goldberg |
| 3,465,456 | A | 9/1969 | Meyer |
| 3,466,766 | A | 9/1969 | Kahlbacher |
| 3,477,149 | A | 11/1969 | Wagner |
| 3,547,203 | A | 12/1970 | Jackoboice |
| 3,557,850 | A | 1/1971 | Owens et al. |
| 3,583,084 | A | 6/1971 | Farrell |
| 3,604,517 | A | 9/1971 | Clifford |
| 3,665,622 | A | 5/1972 | Lamb |
| 3,755,933 | A | 9/1973 | Lowrey |
| 3,793,752 | A | 2/1974 | Snyder |
| 3,845,870 | A | 11/1974 | Balderson et al. |
| 3,941,262 | A | 3/1976 | Moser et al. |
| 4,004,695 | A | 1/1977 | Hockensmith et al. |
| 4,019,268 | A | 4/1977 | Waterman |
| 4,027,409 | A | 6/1977 | Stepe |
| 4,071,155 | A | 1/1978 | Hart et al. |
| 4,094,348 | A | 6/1978 | Wolf |
| 4,220,210 | A | 9/1980 | Degelman |
| 4,249,323 | A | 2/1981 | Mathis |
| 4,255,878 | A | 3/1981 | Mahler et al. |
| 4,275,514 | A | 6/1981 | Maura |
| 4,288,932 | A | 9/1981 | Kuper |
| 4,306,362 | A | 12/1981 | Waterman |
| 4,356,645 | A | 11/1982 | Hine |
| 4,439,088 | A | 3/1984 | Summa |
| 4,446,639 | A | 5/1984 | Bohn |
| 4,478,289 | A | 10/1984 | Enix |
| 4,531,713 | A | 7/1985 | Balboni |
| 4,552,250 | A | 11/1985 | Luebrecht |
| 4,570,366 | A | 2/1986 | Yost |
| 4,577,423 | A | 3/1986 | Hahn |
| 4,597,205 | A | 7/1986 | Guest |
| 4,686,802 | A | 8/1987 | O'Driscoll |
| 4,704,811 | A | 11/1987 | Jefferson |
| 4,707,936 | A | 11/1987 | Steinhoff |
| 4,723,609 | A | 2/1988 | Curtis |
| 4,741,116 | A | 5/1988 | Engle |
| 4,779,363 | A | 10/1988 | Boutrais et al. |
| 4,819,349 | A | 4/1989 | Mensch |
| 4,819,955 | A | 4/1989 | Cobb |
| 4,899,472 | A | 2/1990 | Winter |
| 4,936,392 | A | 6/1990 | Kitchin |
| 4,962,600 | A | 10/1990 | Zellaha |
| 5,014,451 | A | 5/1991 | Bandzul |
| 5,046,271 | A | 9/1991 | Daniels |
| 5,050,322 | A | 9/1991 | Burkard |
| 5,079,866 | A | 1/1992 | Farrell |
| 5,109,618 | A | 5/1992 | Grubler et al. |
| 5,114,296 | A | 5/1992 | Badder |
| 5,121,562 | A | 6/1992 | Feller |
| 5,129,169 | A | 7/1992 | Aubichon |
| 5,136,795 | A | 8/1992 | Rosenberg |
| 5,285,588 | A | 2/1994 | Niemela |
| 5,297,351 | A | 3/1994 | Cote |
| 5,338,148 | A | 8/1994 | Ronnblom |
| 5,392,538 | A | 2/1995 | Geerligs |
| D358,401 | S | 5/1995 | Devaney |
| 5,411,102 | A | 5/1995 | Nickels |
| 5,437,113 | A | 8/1995 | Jones |
| 5,471,770 | A | 12/1995 | Ferreira |
| 5,473,541 | A | 12/1995 | Ishino et al. |
| 5,477,930 | A | 12/1995 | Degelman et al. |
| 5,484,192 | A | 1/1996 | Degelman |
| 5,484,250 | A | 1/1996 | Gilmore et al. |
| 5,535,830 | A | 7/1996 | Matsushita et al. |
| 5,568,694 | A | 10/1996 | Capra |
| D377,653 | S | 1/1997 | Matisz et al. |
| 5,595,007 | A | 1/1997 | Biance |
| 5,599,135 | A | 2/1997 | Delaurenti |
| 5,611,157 | A | 3/1997 | Ferreira |
| 5,622,229 | A | 4/1997 | Degelman |
| D379,464 | S | 5/1997 | Bruns |
| 5,655,318 | A | 8/1997 | Daniels |
| 5,667,004 | A | 9/1997 | Kroetsch |
| 5,682,953 | A | 11/1997 | Buysse |
| 5,697,731 | A | 12/1997 | Bonds |
| 5,724,755 | A | 3/1998 | Weagley |
| 5,729,919 | A | 3/1998 | DeBoer |
| 5,743,032 | A | 4/1998 | Vauhkonen |
| 5,799,737 | A | 9/1998 | Kamikawa et al. |
| 5,815,957 | A | 10/1998 | McKeown |
| 5,819,444 | A | 10/1998 | Desmarais |
| 5,860,230 | A | 1/1999 | Daniels |
| 5,894,689 | A | 4/1999 | Turk |
| 5,899,007 | A | 5/1999 | Niemela et al. |
| 5,938,399 | A | 8/1999 | Knutson |
| 6,049,927 | A | 4/2000 | Thomas et al. |
| 6,112,438 | A | 9/2000 | Weagley et al. |
| 6,134,813 | A | 10/2000 | Vickers |
| 6,269,556 | B1 | 8/2001 | Kallqvist |
| 6,298,585 | B1 | 10/2001 | Boulet |
| 6,314,666 | B1 | 11/2001 | Klemenhagen et al. |
| 6,347,465 | B1 | 2/2002 | Jensen |
| 6,360,459 | B1 | 3/2002 | Brookhart et al. |
| 6,425,196 | B1 | 7/2002 | Weagley et al. |
| 6,439,279 | B1 | 8/2002 | Underwood |
| 6,460,643 | B1 | 10/2002 | Degelman |
| 6,470,604 | B1 | 10/2002 | Foster et al. |
| 6,481,506 | B2 | 11/2002 | Okada et al. |
| 6,526,678 | B2 | 3/2003 | Waddington |
| 6,536,141 | B2 | 3/2003 | Kitchell |
| 6,546,707 | B2 | 4/2003 | Degelman et al. |
| 6,560,904 | B2 | 5/2003 | Guggino |
| D478,097 | S | 8/2003 | Vennard et al. |
| 6,612,050 | B2 | 9/2003 | Takeuchi |
| 6,778,932 | B2 | 8/2004 | Struck et al. |
| 6,845,576 | B2 | 1/2005 | Vennard et al. |
| D511,173 | S | 11/2005 | Fatemi |
| D511,174 | S | 11/2005 | Fatemi |
| D512,443 | S | 12/2005 | Fatemi |
| D519,128 | S | 4/2006 | Vennard et al. |
| D519,129 | S | 4/2006 | Vennard et al. |
| 7,351,028 | B2 | 4/2008 | Potter et al. |
| D570,377 | S | 6/2008 | Evans et al. |
| 7,412,787 | B2 | 8/2008 | Sutton et al. |
| 7,647,983 | B2 | 1/2010 | Gharsalli |
| 7,654,016 | B2 | 2/2010 | Stephan |
| 7,743,536 | B2 | 6/2010 | Evans et al. |
| 7,805,863 | B2 | 10/2010 | Vennard |
| 8,191,288 | B2 | 6/2012 | Weagley et al. |
| 2003/0101626 | A1 | 6/2003 | Johnson |
| 2003/0221340 | A1 | 12/2003 | Ganswich |
| 2004/0250454 | A1 | 12/2004 | Jager |
| 2005/0097786 | A1 | 5/2005 | Vennard et al. |
| 2005/0126051 | A1 | 6/2005 | Fatemi |
| 2006/0070759 | A1 | 4/2006 | Nesseth |
| 2007/0107271 | A1 | 5/2007 | Weagley et al. |
| 2007/0107272 | A1 | 5/2007 | Weagley et al. |

(56) References Cited

U.S. PATENT DOCUMENTS

| | | | |
|---|---|---|---|
| 2008/0235996 | A1 | 10/2008 | Evans et al. |
| 2009/0090032 | A1 | 4/2009 | Yang et al. |
| 2009/0309779 | A1 | 12/2009 | Buckbee et al. |

FOREIGN PATENT DOCUMENTS

| | | |
|---|---|---|
| DE | 8300983 | 6/1983 |
| FR | 2539438 | 7/1984 |
| JP | 7088642 | 4/1995 |
| SE | 503193 | 4/1996 |
| SE | 01115-0 | 5/2005 |
| WO | WO9008234 | 7/1990 |
| WO | WO9107345 | 5/1991 |
| WO | WO2006123982 | 11/2006 |

OTHER PUBLICATIONS

Bonnell Push 'N-Plow brochure; 5 pages; Bonnell Industries Inc., 1385 Franklin Grove Rd., Dixon, IL 61021; Fax Date May 3, 2002.
Bonnell What's New 4 Webpages, 2001; bonnell.com; Bonnell Industries, Inc. advertising Push n. Plow snow plow.
Buffalo Truck Equippers, Inc. Snow Pushers Advertisement; Buffalo Truck Equippers, Inc., 740 Hinman Ave, Buffalo, NY 14207; 2 pages; Truck Trader Oct. 25-Nov. 1, 2000—Issue 44.
Communication enclosing Ronnbloom 1 page brochure; dated Jan. 31, 1998.
Daniels Box Plow; A Box Plow with a Steel Tip Edge; www.danielsplows.com; 1advertising page; Great Lakes & Northeast Blg Truck & Equipment Traders—Apr. 27, 2001; Issue #16.
Degelman 40 years Brochure 1962-2002; 24 pages; Degelman product brochure 2002; Degelman Industries Ltd; 272 Industrial Dr. Regina, SAS, CA S4P 3B1; degelman.com.
Degelman Brochure; 16 pages; Degelman Industries Ltd; WWW.DEGELMAN.COM.
Degelman Dozer Blades 3400 Series brochure, 92 pages, 1978-1980, Degelman Industries Ltd., PO Box 830, Regina, SAS, CA.
Degelman Dozer Blades 4400 Series brochure, 94 pages, 1978-1980, Degelman Industries Ltd., PO Box 830, Regina, SAS, CA.
Degelman Dozer Blades 4WD Series brochure, 95 pages, 1978-1980, Degelman Industries Ltd., PO Box 830, Regina, SAS, CA.
Degelman Dozer Blades brochure; 4 pages;Degelman Industries Ltd., PO Box 830, Regina, SAS, CA; Earliest publication date unknown, available approx. Jan. 1, 1980.
Fair Mfg. Snow Removal Equipment; 3 webpages; web archive 2000.
FFC; 4 webpages; www.ffcattachments.com; Nov. 29, 2000; FFC, 100 E. Lee Road; Box 122, Lee, IL 60530.
FFC; Lawn & Landscape—Snow—Sep. 1998, p. 59.
First Place Pusher brochure 2 pages; May 2002; First Place Pusher, Route 68, Rutland MA 01543.
FR2539438—An Abstract of French Patent FR2539438 issued Jul. 20, 1984 (Application FR19840000510 Filed Jan. 13, 1984); Inventor Kueper, Walter; Applicant Kuper Gummi GMBH [DE].
HL Machineries; Ma Revue de Machinerie Agricole, 1 pages advertisement; Oct. 2001; HL Machinerie, 7850 Boul. Parc Industrie!, Ste-Gertrude (QC) CA G0X 2S0.
JP7088642—JP19930257525 Abstract and Machine Translation of JP7088642; Apr. 4, 1995; (JP application JP19930257525).
JRB Quick Couplers & Attachments brochure 4 pages; JRB Company, Inc.; 2444 Gilcrist Rd., Akron, OH 44305.
Ledex Avalanche Bury the Competition Advertisement 5 pages; 1998; Ledex Industries Corp, 307 Humberline Drive, Toronto, Ontario, CA.
Ledex Avalanche loader; Apr. 23, 2002;ledexindustries.com/avalanche/loader; 5 pages; Snow Plow Supply—Arctic Snow Plows; snowplowsupply.com/avalanche; pages; Avalanche loader, backhoe, Skid-steer.
Ledex Avalanche with Bobcat 763, 1 webpage, web.archive.org/web/20010409071050/www.ledexindustries.com/avalanche/skidsteer; 2001.
Monroe Snow and Ice Control Brochure; 3 pages; Monroe Snow Removal Systems for Construction Machinery, 1051 W. 7th St., Monroe, WI 53566.
Orsolini Drawing; Orsolini Welding and Fabrication, 2006 W. Superior, Chicago, IL; Isometric Drawing of Rear End Plow dated Jan. 6, 1978.
Pro-Tech Fold Out Pusher FOP brochure 1 page c. 2001; Pro-Tech, 711 West Ave., Rochester, NY.
ProTech Material Handler Box; 1 page brochure; Protech Manufacturing and Distribution, 711 West Ave., Rochester, NY 14611; 1998.
Pro-Tech Snopushers Brochure; 4 pages.
Pro-Tech Welding & Fabrication, Inc., Industrial & Contractor Services Brochure; 4 pages.
RCS SnoPro Ads Specifications; 5 pages; RCS Sno-Pro, 1029 Lyell Ave., Rochester, NY.
RCS SnoPro Clear Path 4 Webpages; 2002; ClearPathProducts.com.
RCS SnoPro color advertisement, 1 page; RCS Manufacturing and Development, 1029 Lyell Ave., Rochester, NY.
RCS Pro Series advertisement from www.rcssnopro.com (pre-2006).
RCS SnoProWinter Weather; 1 webpage; 2004; winterweatherservices.com.
Ronnblom Swedish Communication with translation and Drawing Sheet; No date available.
SnowPlow Supply 4 Webpages; Mar. 2001; snowplowsupply.com.
Snowpro, Cygnus Magazine Supplement 2—1998; 22 pages; Snow Pro Supplement, 1233 Janesville Ave., Fort Atkinson, WI 53538.
Snowpro, Magazine Supplement 1—1997; 28 pages; Snow Pro Supplement, 1233 Janesville Ave., Fort Atkinson, WI 53538.
Snowpro, Magazine Supplement 2—1997; 24 pages; Snow Pro Supplement, 1233 Janesville Ave., Fort Atkinson, WI 53538.
Tenco Machinery Ltd, engineers snow equipment, products, web pages; 4 pgs; c.1998; web.archive.org/web/20010906132217; download Apr. 4, 2007; Hansen invoice dated Dec. 7, 1999 sale of Tenco TC-272 14LM (1 pg); photo of.
Tenco Snowblower TC-272 brochure specification sheet; 2 pages; c. 1994; Tenco Machinery (CDN) Ltd; C.P. 60, St-Valerien-de-Milton, Quebec, CA J0H 2B0;telephne 450-549-2411; website tenco.ca.
Tenco TC-272 Snowblower Manual 14292; operator's parts & maintenance manual & parts catalog; 1999; Les Machineries Tenco (CDN) ; 1318, Principale, St-Valerien-de-milton, Quebue, CA J0H 2B0; website tenco.ca; 70 pages.
CA2566993—the prosecution history for Canadian patent CA2566993 issued Oct. 2, 2012; filed Nov. 2, 2006 corresponding to U.S. Patent 8191288 inventor: Michael P. Weagley et al.
U.S. Appl. No. 11/556,106—8,191,288—file history for U.S. Patent 8,191,288 issued Jun. 5, 2012; U.S. Appl. No. 11/556,106 filed Nov. 2, 2006, published May 17, 2007, US20070107271;Weagley et al.
CA2566988—prosecution history as of Apr. 22, 2013 for Canadian patent application CA2566988 filed Nov. 2, 2006; corresponding to U.S. Appl. No. 11/556,116; inventor: Michael P. Weagley et al.
U.S. Appl. No. 11/556,116—the file history as of Apr. 22, 2013 for U.S. Appl. No. 11/556,116 filed Nov. 2, 2006, published May 17, 2007, as US20070107272; inventor: Michael P. Weagley et al.
PCTUS1325241—an international search report and written opinion dated May 6, 2013 for PCTUS1325242 filed Feb. 8, 2013, corresponding to U.S. Appl. No. 13/761,347; inventor Michael J. Guggino.

MATERIAL PUSHER WITH CONTROL SYSTEM

This application claims priority under 35 U.S.C. §119 to the following provisional patent applications: U.S. Provisional Application 61/596,773, for a SNOW PUSHER, filed Feb. 9, 2012 by M. Guggino et al.; U.S. Provisional Application 61/624,640, for a SNOW PUSHER, filed Apr. 16, 2012 by M. Guggino et al.; and U.S. Provisional Application 61/661,629, for a SNOW PUSHER WITH IMPROVED SCRAPING AND COUPLING SYSTEM, filed Jun. 19, 2012 by M. Guggino et al., all of which are hereby incorporated by reference in their entirety.

The following disclosure is directed to various aspects of a snow or material pusher including a sensor system to assist a user with monitoring and controlling operation of the pushing apparatus, an improved coupling assembly. In one embodiment the material pusher includes at least one of the following: an equipment coupler having a shock absorbing compliant interface, an improved chassis manufactured using tab and slot components, wear shoes that are disassociated from the side plates of the plow chassis, and a multi-component cutting or scraping edge, where the aggressiveness of the edge and/or tilt angle of the pusher is monitored by a sensor. Also disclosed are side plates having external reinforcing gussets and a compliant lower working surface for moving snow or other materials over large areas such as parking lots, roadways, runways and the like.

BACKGROUND AND SUMMARY OF THE INVENTION

A material "pusher" or "pushing apparatus" or "containment plow" as described for example in U.S. Pat. No. 5,724,755 to Weagley, hereby incorporated by reference in its entirety, generally includes at least one side extending forward and perpendicular from a mold board or central blade to assure that the material to be displaced is contained and remains in a position along and ahead of the pusher, and is not directed or permitted to roll off either side, as is the case with conventional plows.

Conventional pushers or containment plows, particularly those having sides and wear shoes that extend in front of the central blade, often experience difficulty in tracking the surface being plowed. In particular they may fail to thoroughly clean material (e.g., snow, ice) from depressions in such surfaces because the scraping edge of the plow is unable to contact a depressed surface, or when one side of the plow is lifted as the side wear shoe passes over a raised region. The disclosed material pusher includes a number of features that are designed to significantly improve the surface outcome or performance of such devices. For example, the disclosed embodiments avoid rigid contact with the surface being plowed ahead of the blade or scraping edge. And the use of a segmented, two-edged scraping edge, allows small sections of the overall scraping edge to adapt to depressions in the surface being plowed so that "bird bath" (puddle) depressions are not missed. Moreover, the use of flexible/compliant materials, the re-positioning of wear shoes and an improved coupling mechanism that rigidly attaches the apparatus to a bucket, yet provides a degree of compliance between the loader and the pushing apparatus, enable the apparatus to reliably track the surface being cleared. These improvements, along with on-board sensors to monitor down pressure and/or tilt of the apparatus, assure that the apparatus can be effectively employed to provide improved material pushing performance when compared to conventional containment plows.

Accordingly, the following disclosure is directed to aspects and embodiments of an improved pusher or containment plow including an equipment coupler having a shock absorbing compliant interface, an improved chassis manufactured using tab and slot components, wear shoes that are disassociated from the side plates of the plow chassis, and a multi-component scraping edge, where the tilt of the pusher and/or the aggressiveness of the edge is monitored by a sensor system. Also disclosed are side plates having external reinforcing gussets and a compliant lower working surface for moving snow or other materials over large areas such as parking lots, roadways, and runways, for example.

In some embodiments, the disclosed material pusher can be affixed as an extension to the bucket of a front end loader or backhoe, and accordingly the material pusher may be interconnected via an engagement of the bucket within a receiving structure located on the backside of the pusher. For example, attached to the back of the moldboard. In other embodiments one of a number of quick-coupling mechanisms known for use on skid steer and other heavy equipment buckets and attachments may be employed.

In accordance with an aspect of one embodiment disclosed herein, there is provided a material pushing apparatus, comprising: an upstanding central blade, including a longitudinal edge along a bottom side of said blade, and at least one removable side plate attached to and extending generally forward from the central blade near an end thereof; a scraping edge flexibly attached to the central blade along the bottom longitudinal edge; and a position sensor for monitoring relative position between the scraping edge and central blade, and producing a position signal representing the relative position.

In accordance with another aspect disclosed herein there is provided a method for operating a material pushing apparatus, said apparatus comprising a material pushing apparatus, including an upstanding central blade, having a longitudinal edge along a bottom side of said blade, and at least one removable side plate attached to and extending generally forward from the central blade near an end thereof; a scraping edge flexibly attached to the central blade along the bottom longitudinal edge; a position sensor for monitoring relative position between the scraping edge and central blade, and producing a position signal representing the relative position; a tilt sensor for monitoring relative tilt angle of the central blade, and producing a tilt signal representing the relative tilt angle; a visual indicator; and a processor; said processor operating in accordance with a program stored in memory associated with said processor, to periodically receive at least one of the position signal and the tilt signal as inputs and to update at least one output signal in response thereto, where a representation of the output signal is displayed on the visual indicator.

In accordance with a further embodiment, there is disclosed a material pushing apparatus, comprising: an upstanding central blade, including a longitudinal edge along the bottom side of said blade, and left and right vertical side plates attached to and extending generally forward from or near each of the ends of the central blade, said side plates being bolted on and detachable from the blade, and including a flexible skirting on the bottom thereof, said skirting being inwardly biased and held at the bottom edge of the side plates; a scraping edge(s) flexibly attached to the central blade along the bottom longitudinal edge, where the scraping edge includes both forward facing and rearward facing components that are angularly oriented and spaced apart; a coupler flexibly attached to the rear of the blade for attaching the pushing apparatus to a bucket of a vehicle for moving the pushing apparatus, said coupler including a plurality of C-shaped receivers, at least one of said receivers including opposed upper and lower arms extending rearward relative to the central blade and forming a slot therebetween for receiving an edge of the bucket, wherein at least one of said arms further includes a cam having a high friction surface thereon (e.g., teeth) for contacting a surface of the bucket when the bucket is placed in the slot, the cam thereby affixing the bucket to the coupler (without the need for additional chains or other binding devices); a sensor for monitoring the relative position between the scraping edge and blade, and optionally including a visual indicator to reflect change in the relative position); and a pivotable wear shoe attached to and behind the central blade to provide a further ground contact surface behind the apparatus when in operation.

Also disclosed with respect to yet a further embodiment is a pushing apparatus including an inverted "V" or angled scraping edge(s) for attachment along the lower longitudinal edge of a pusher moldboard, comprising: a plurality of rigid sections; said sections being compliantly or flexibly attached along a bottom edge of the blade so as to be displaceable in order track the surfaces being plowed and provide improved surface outcome, as well as to yield to other irregularities within the surface being plowed (e.g., curbs, manhole covers, sewer grates, etc.), thereby preventing damage to the irregular object as well as the scraper blade section.

Figure 1:
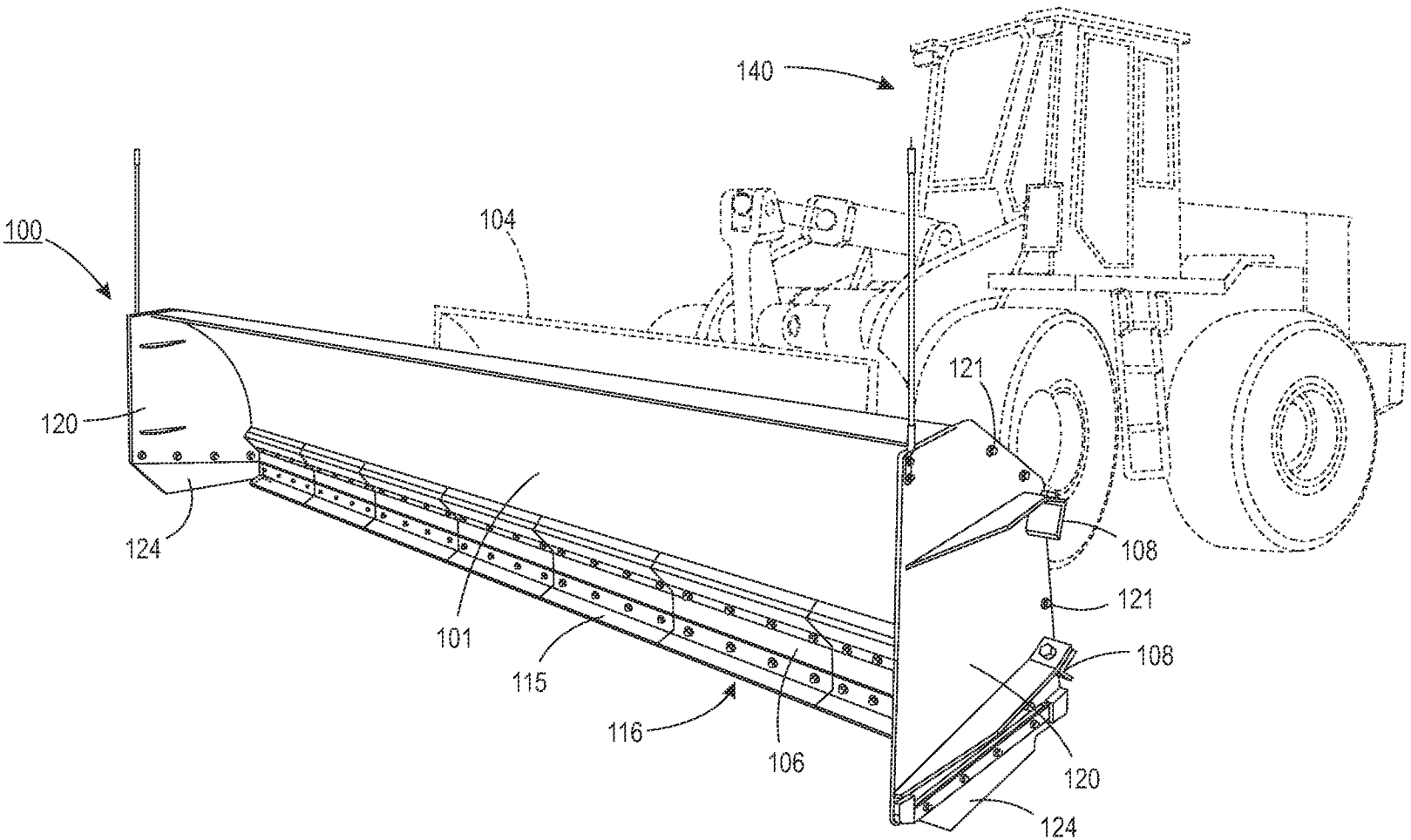
FIG. 1 provides an illustrative example of the disclosed material pushing apparatus as connected to a loader bucket.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Referring to FIG. 1, depicted therein is a pusher 100 connected to a bucket 104 of a front-end loader 140 in accordance with aspects of the disclosed embodiments. The specific operational features and components of the coupler embodiments will be discussed in detail below.

The material pushing apparatus or pusher 100 includes an upstanding central blade 101, where the blade has a longitudinal edge along the bottom and left and right side plates 120 that are attached to and extend generally forward from or near each of the ends of the central blade. The side plates may extend forward in a direction perpendicular to the central blade, or they may be angle slightly outward or contain one or more breaks and planes to produce an outward flare. In the illustrated embodiments, the side plates 120 are fastened to the ends of the main blade along an edge, where fasteners such as bolts 121 pass through the edge of the plate as well as an end flange or similar member of the central blade. It will be appreciated that the side plates of the disclosed embodiments do not include an interior reinforcement member between the blade and the side plate. The side plates do, however, include braces 125 that extend along the exterior of the plates 120 and are interconnected with the side plate using tab-and-slot type construction. The exterior bracing avoids or reduces undesirable interference within the confines of the material pusher cavity, to assure that snow and other material has a uniform flow.

The side plates are also attached, again using fasteners such as bolts, to rigid reinforcing members 108 that span the length of the central blade and extend beyond the ends of the blade and through a slot in the side plate. As a result of this attachment method, side plates 120 are detachable from the blade so that one or both may be removed for windrow-type plowing, for compact storage and shipping, or for replacement. Side plates 120 further include flexible skirting 124 on the bottom thereof, where the skirting may be inwardly biased and held at the bottom edge of the side plates. Skirt 124 is removably attached along the bottom portion of side plate 120 to provide a compliant edge, to mitigate the potential damage to an obstruction, as well as to side plate 120 itself. The skirting material may be any number of polymer or reinforced rubber materials that will provide containment of the material being moved, such as rubber applied on a woven material such as in conveyor belting, etc. Moreover, as the skirting material wears, it may be periodically replaced.

Figure 2:
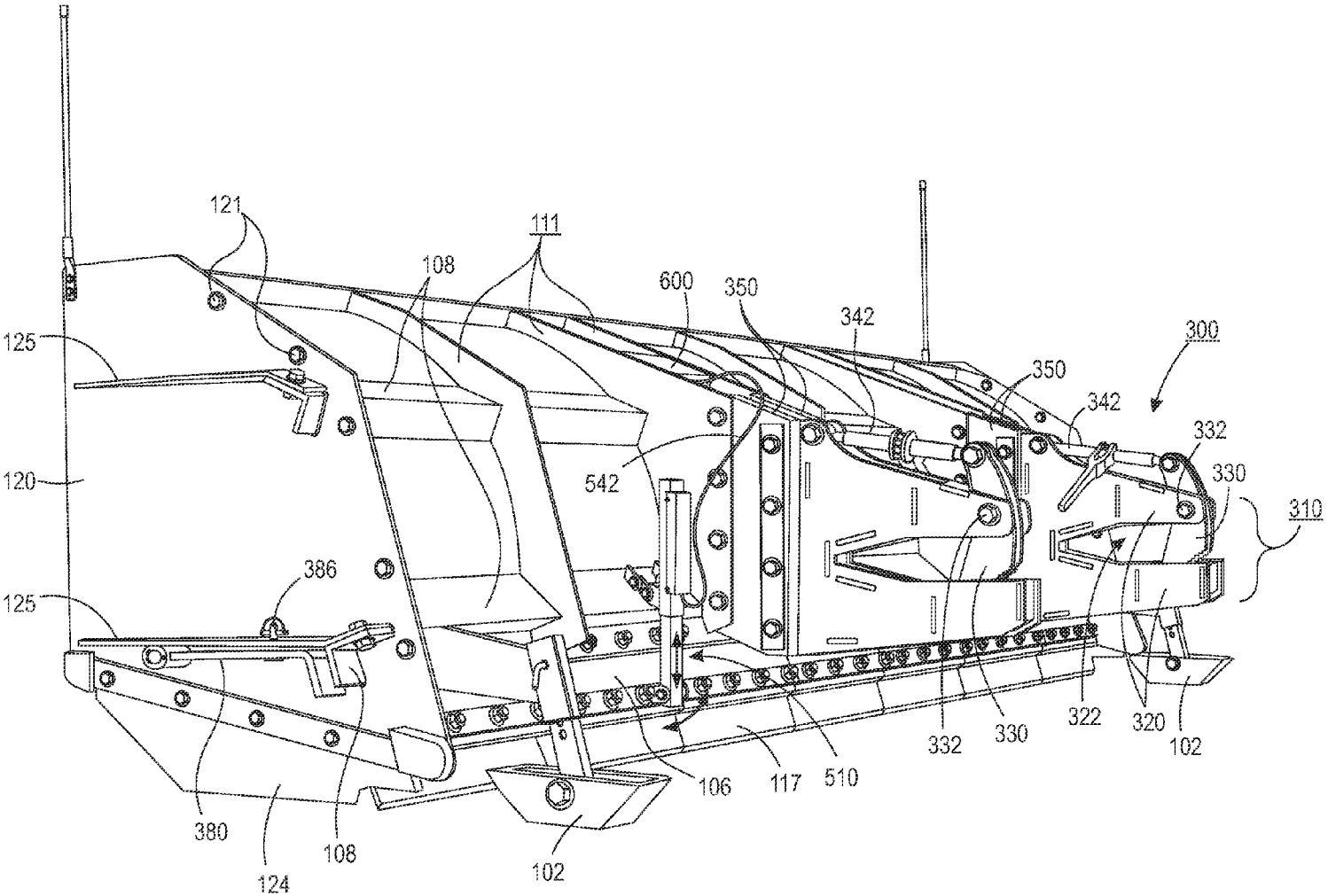
FIG. 2 depicts a perspective view of the side and rear of the material pushing apparatus.

Although the bottom edge of the material pushing apparatus 100 may include a number of alternative edges or scraping technologies, the embodiments depicted in FIGS. 1-3 and 6 for example, include longitudinal metal scraping edge(s) 116 that are flexibly or compliantly attached to the central blade 101 along its bottom longitudinal edge via flexible polyurethane members 106. In the illustrated embodiment, the scraping edge is comprised of a number of longitudinal segments, where each includes both a forward facing component 115 and a rearward facing component 117 that are angularly oriented so that the lower edges thereof are spaced apart from one another. As noted, the scraping edge includes a resilient or compliant member 106 attached along the bottom longitudinal edge of the blade 101. As illustrated, the member 106 may be oriented so that the top is forward of the bottom—putting the compliant member in a "dragging" orientation to assure flexure when the scraping edge comes into contact with a structure. To the bottom edge of compliant member 106 is attached the scraping edge 116. Scraping edge 116 is shown having a forward and reward section longitudinally attached to one another at an angle of approximately 70-90 degrees to form an inverted "V" shape for component edges 115 and 117. The material used for the scraping edges themselves may be hardened, abrasion resistant steel. As seen in FIGS. 1 and 2, for example, numerous segments of scraper 116 are removably attached to the compliant members 106, so that when a surface obstruction is encountered the flexibility of member 106 flexes and prevents permanent damage to either the protruding obstruction or scraping edge 116. It is further contemplated that other scraping edge configurations may be employed with the disclosed pusher, including single edges polyurethane edges or a plurality of edges as depicted.

As an alternative embodiment, it is further contemplated that the plow blade may be produced in sections that may then be bolted together. Each section would have an adjoining or abutting end plate that allows it to be connected to an adjoining section. For example, an eight-foot center section with a clamp and coupler may have one or more sections attached on either side to produce the final plow configuration. Moreover, it is contemplated that the plow may have side sections of different lengths on each end so that the plow may be used to plow under the ends of trailers, airplane wings, etc.

Figure 3:
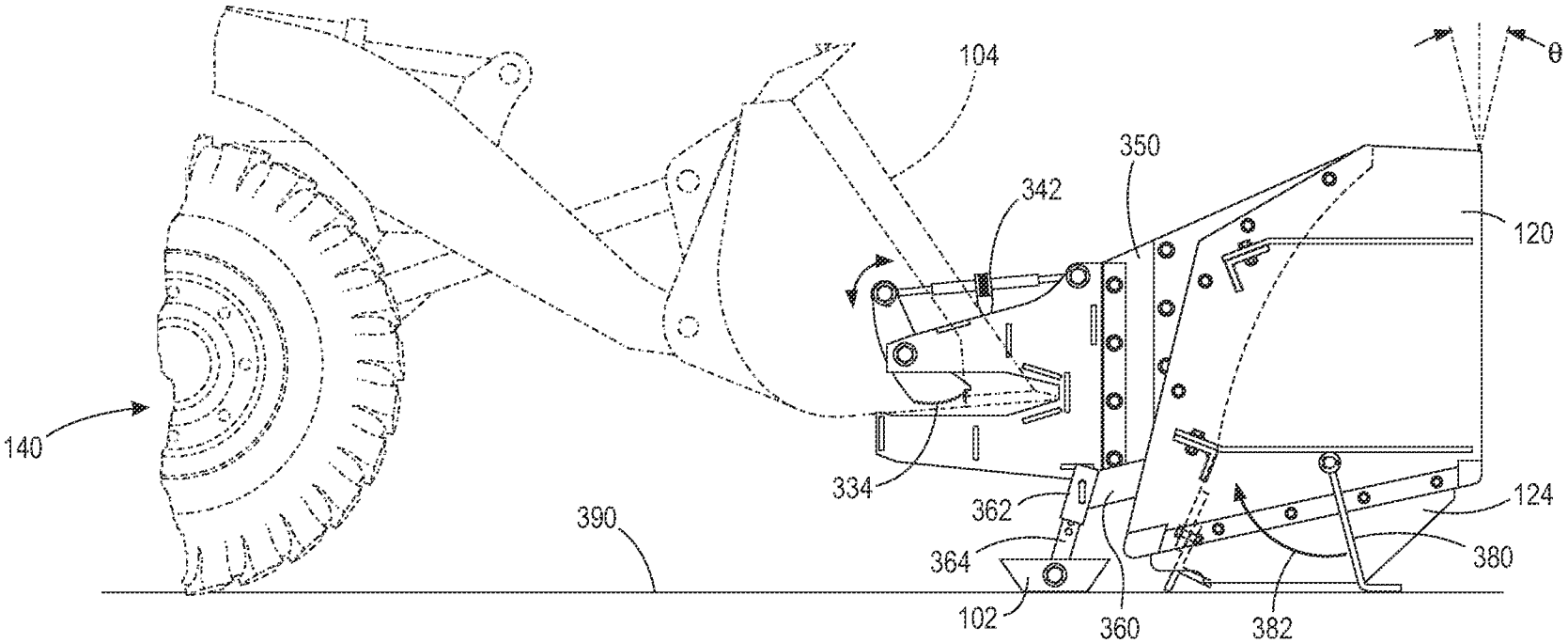
FIG. 3 presents a side view of the disclosed material pushing apparatus showing its attachment to the bucket of a vehicle such as a loader.
Figure 4:
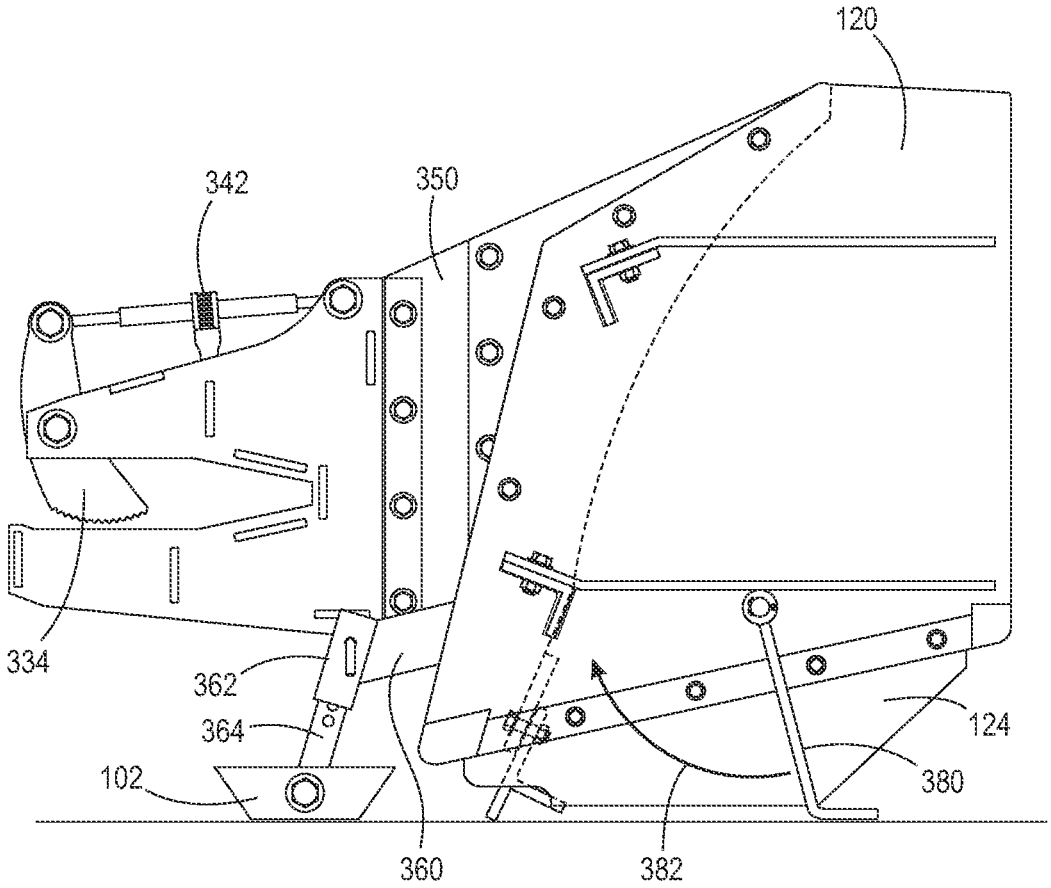
FIG. 4 illustrates a side view of the material pushing apparatus shown resting on a surface.

As illustrated in FIGS. 2 and 3, for example, attached to the rear of the material pusher is a pivotable wear shoe mounted behind the scraping edge and inboard of the side plates, behind the central blade. In this configuration, the wear shoes 102 to provide a further ground contact surface behind the apparatus, when being stored and when in operation. In the interest of maintaining the pusher in an even, albeit compliant, plowing orientation, the left and right pivoting wear shoes 102 provide points of contact. As will be appreciated, the angular position of bucket 104 controls the general position and orientation between a surface to be plowed 390 and scraping edge(s) 116. A benefit afforded by adding the pivotable shoes 102 is to ensure that the attack angle of the blade and associated scraping edge 116 remains at an angle that is optimized for plowing. And, by using a pivoting skid shoe 102 as a control point, the orientation of the blade 101 is maintained in an upright position with the scraping edge(s) contacting the surface to be plowed as intended. Such a feature was previously unattainable with the use of conventional wear shoes attached along the bottom edge of the side plates. As shown, the skid shoes 102 are pivotally attached to the rear of the blade or moldboard by an assembly, including a strut 360 and mount 362 along with a telescoping adjuster bar 364. The wear shoe mount extends rearward and downward from the back surface of the blade 101, but may be similarly attached to any member extending or protruding from the rear of the pusher, possibly including the coupler in some embodiments. Alternatively, the wear shoes themselves may include a plurality of mounting holes at various positions and heights so that the shoes may be adjusted. The wear shoes will not interfere with the surface outcome and reduce or eliminate any chance of curb damage by locating them behind the plow blade. The pin-on, adjustable wear shoes require no tools for replacement or height adjustment, and employ an extremely abrasion resistant material such as AR 300 (high-manganese carbon) steel to extend their life. The wear shoes typically have a sloped front and/or rear surface to permit uninterrupted movement over small changes or discontinuities in the surface being plowed. The use of a sloped rear surface is optional, and would typically be used in situations where it was anticipated that the plow would regularly be moved rearward when in a lowered position.

Also depicted in FIG. 3 is a kickstand 380 that is pivotally connected to each side plate 120. The kickstands are designed to provide, in addition to the wear shoes, a forward surface to rest the apparatus on, when not in use. The kickstand is illustrated in FIG. 3 in an extended or "down" position and may be rotated in the direction of arrow 382 into the stored or "up" position in FIG. 2, where it may be secured in that position using a spring, clip or pin 386 or similar mechanism.

Referring to FIGS. 2-3, a coupler 300 is flexibly attached to the rear of the pusher 100. The coupler is attached to reinforcing gussets 111 on the back surface of blade 101, and the coupler is designed to enable the easy attachment of the pushing apparatus to a bucket 104 of a vehicle 140 for moving the pushing apparatus. The disclosed flexible interface clearly provides or permits relative motion in at least two dimensions, and in certain designs may enable flexure in a third direction. The coupler may be of various configurations, depending upon the nature and type of device it is being attached to, and includes quick-connect, skid steer (quick coupler with top pocket and foot) and other well-known coupling techniques and devices. In such alternative embodiments, the coupler would still include a compliant member separating the coupler from the material pusher in order to provide the desirable compliance between the material pusher and the vehicle in order to improve tracking of the surface being cleared.

In the embodiment depicted, coupler 300 includes a plurality of C-shaped receivers 310, at least one of said receivers including opposed upper and lower arms 320 extending rearward relative to the back of the central blade and forming a slot 322 therebetween for receiving an edge of the bucket. The universal design of the C-shaped coupler 300 fits most buckets and low to the ground for maximum pushing force, aiding primary mover traction and keeping the pushing apparatus in optimum position. The receiver is also assembled using tab-and-slot construction and may include a hardened puck or member at the end of the slot (closest to the blade) to provide a wear surface against which the bucket edge would rest.

At least one of the coupler arms 320 further includes a cam 330 having a high friction surface 334 thereon, such as teeth, for contacting a surface of the bucket 104 when the bucket is placed in the slot. Upon pivoting of the cam using a tensioner 342 such as a ratcheting binder (e.g., Dixie Industries #48363) or similar device, the cam thereby contacts and affixes the bucket to the coupler without the need for additional chains or other binding devices. It will also be appreciated, as described below, that alternative and even remote means may be employed to engage (close) and release (open) the cams 330 relative to bucket 104. More specifically, the cam 330 is rotated about a pivot pin 332, and when rotated under the control of tensioner 342 the cam thereby affixes or clamps the bucket within the coupler, without the need for additional chains or other binding devices.

Furthermore, alternative tensioning devices may include hydraulic cylinders, jacks, screw drives and the like. In the embodiment of a hydraulic cylinder being employed to apply force to the cams 330, the pressurized fluid would be provided either from the vehicle or a dedicated DC pump/reservoir that may be operatively associated with the material pushing device. Notably, the geometry of the cam configuration provides an additional or increasing binding force when the bucket attempts to disengage from the slot while the cams are still contacting the bucket surface.

Each assembly of coupler 300 may be attached to the rear of the material pusher via a pair of compliant shock-absorbing members 350, which are fastened along one edge to the to the C-shaped receivers 310 using bolts and backing plates. The opposite edge of the compliant or shock-absorbing members 350 is similarly fastened to the rear of the material pusher blade along the side of a reinforcing gusset 111. In one embodiment, the shock-absorbing members are made of polyurethane material, typically 1.0-1.5 inches thick. The compliant material used for member 350 may be any substance that is resilient and has the capacity to absorb energy when it is deformed elastically and then upon unloading regains its original shape, such as various rubbers, polymers (e.g., polyurethane) or other shock-absorbing materials (e.g., springs) . The use of a shock-absorbing member between the coupler and the blade assembly of the material pusher permits the blade to move slightly relative to the vehicle so that it is not directly coupled to the vehicle, thereby allowing the material pusher to track or "float" over surfaces independently of the vehicle. Moreover, the flexible nature of the members 350 further permits them to absorb some or all of the shock when the scraping edges or other pusher components come into contact with immovable items such as curbs, manholes, etc., thereby avoiding damage to the vehicle in such situations. Thus, the shock-absorbing or resilient member 350 permits movement of the first connection relative to the second connection, thereby allowing at least some amount of independent motion of the plowing implement 100 relative to the vehicle 140.

Figure 5:
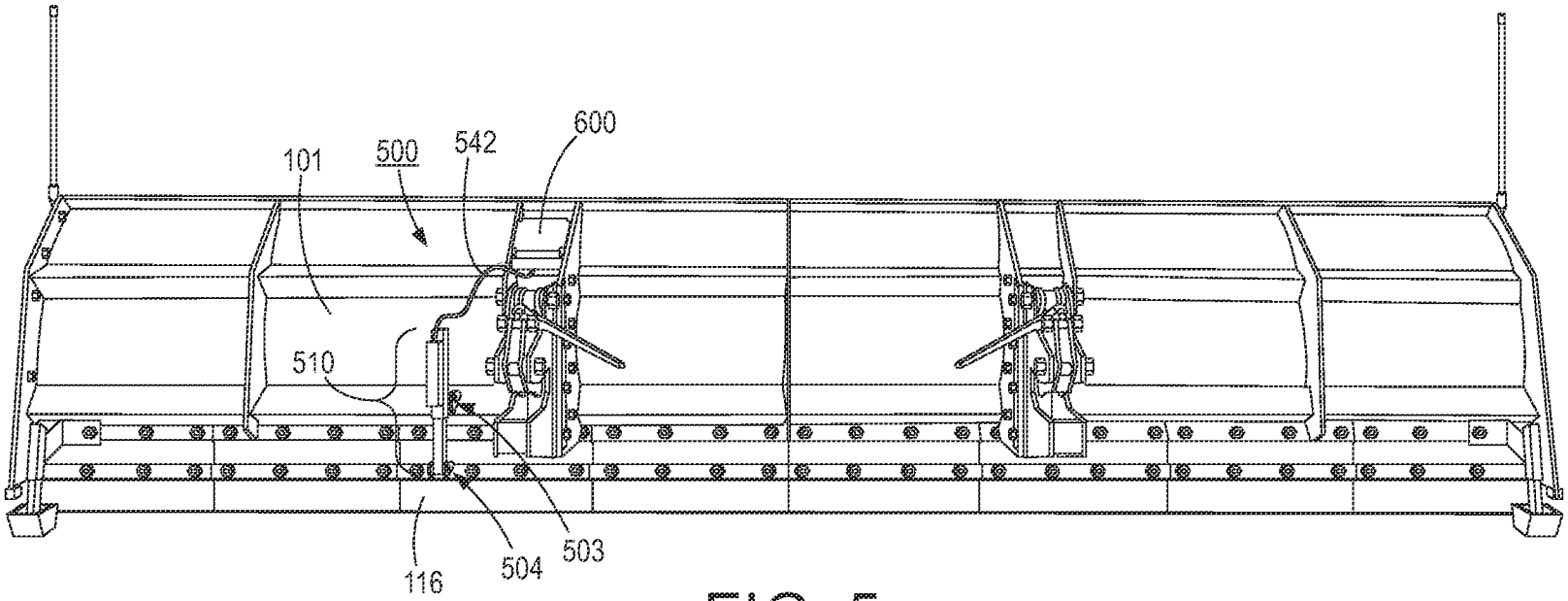
FIG. 5 presents a view of the material pushing apparatus from the rear.
Figure 6:
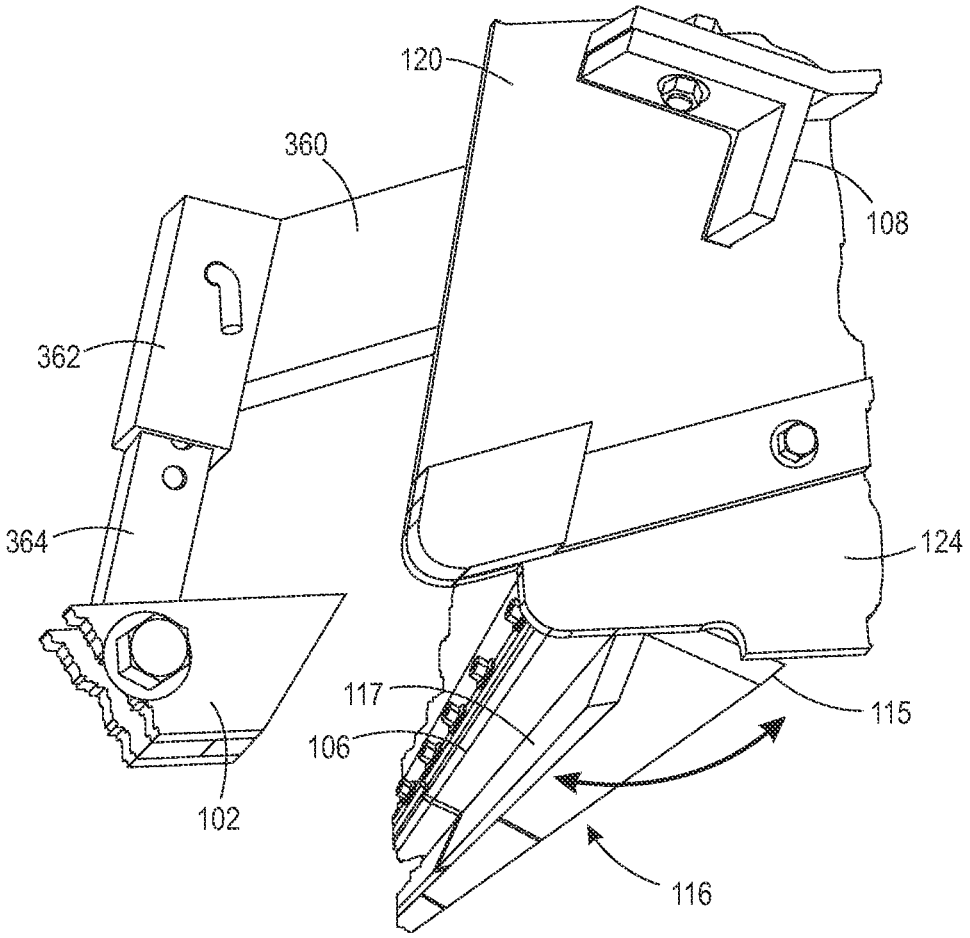
FIG. 6 shows a partial perspective view along the bottom of the material pushing apparatus to illustrate the scraping edge in detail.
Figure 7:
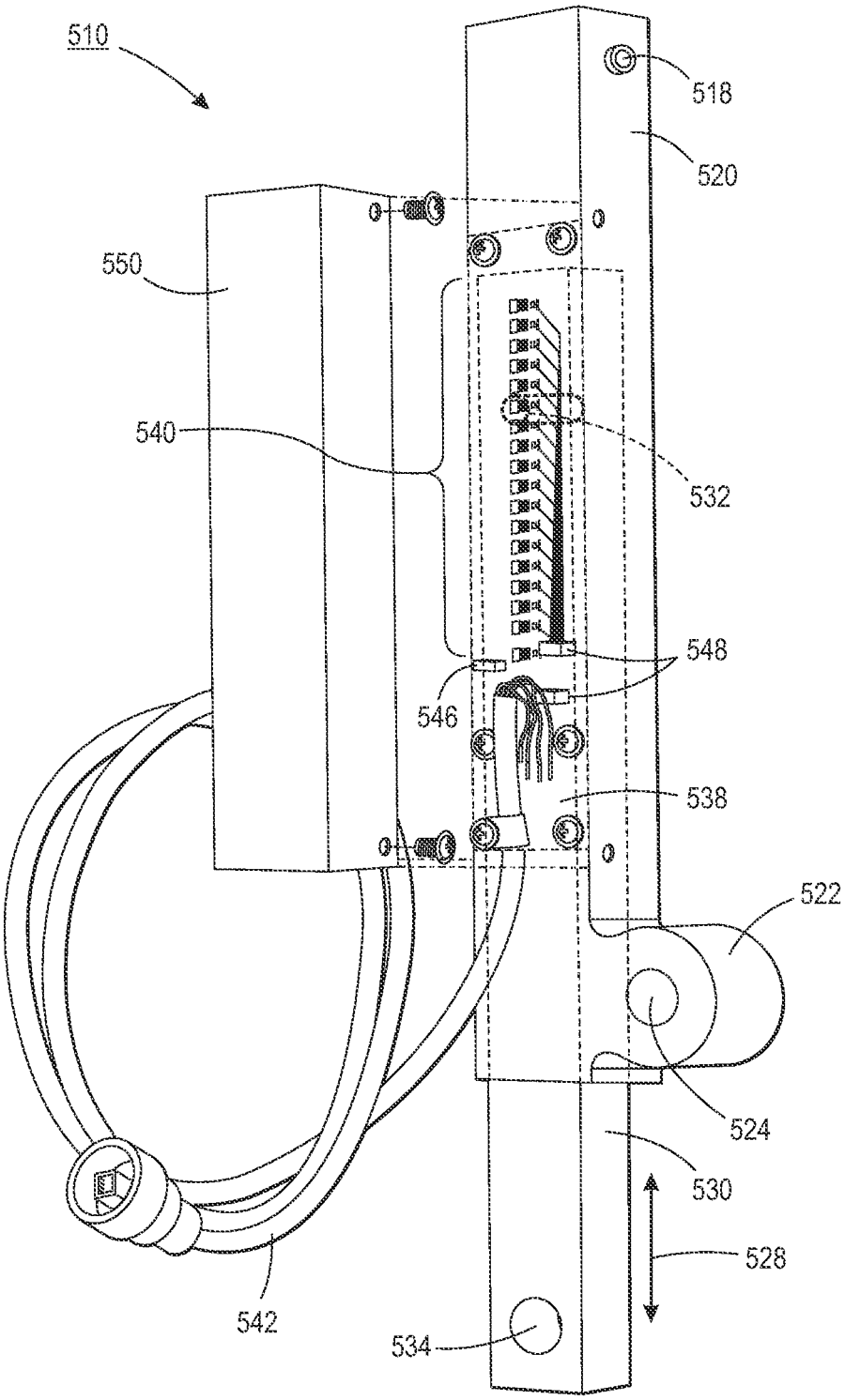
FIGS. 7-9 are illustrative examples of the sensor system components.
Figure 8:
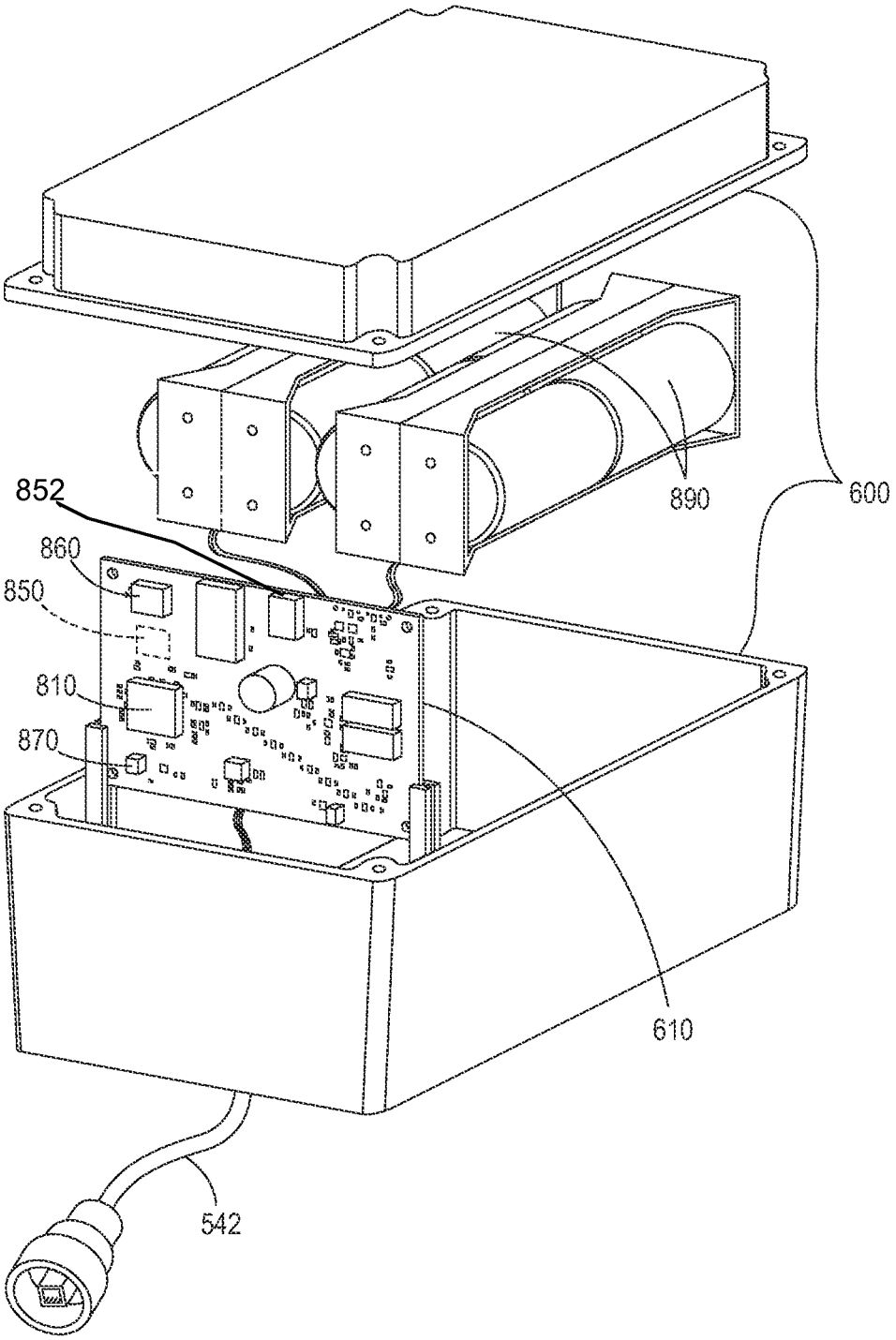
Figure 9:
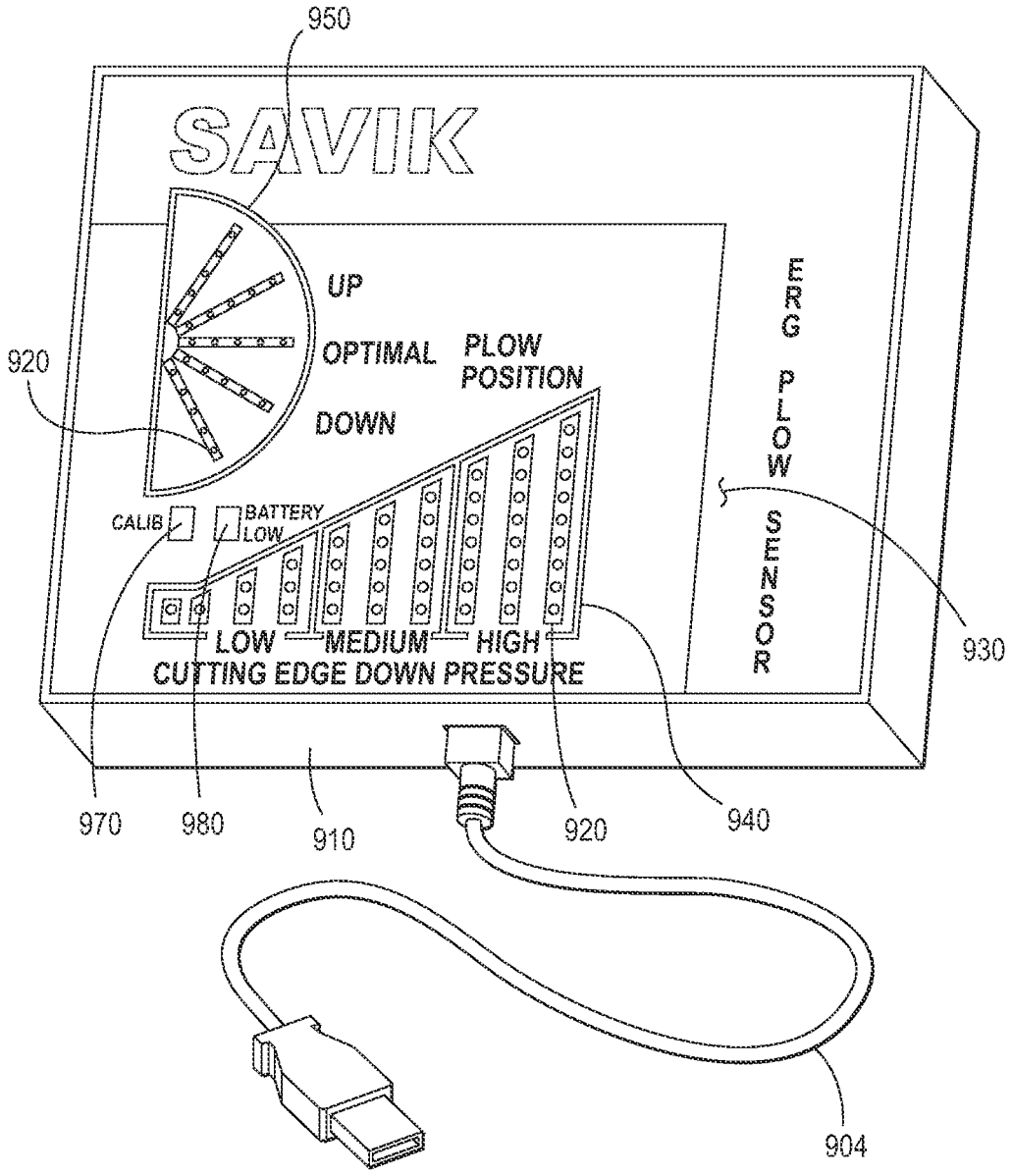
Figure 10:
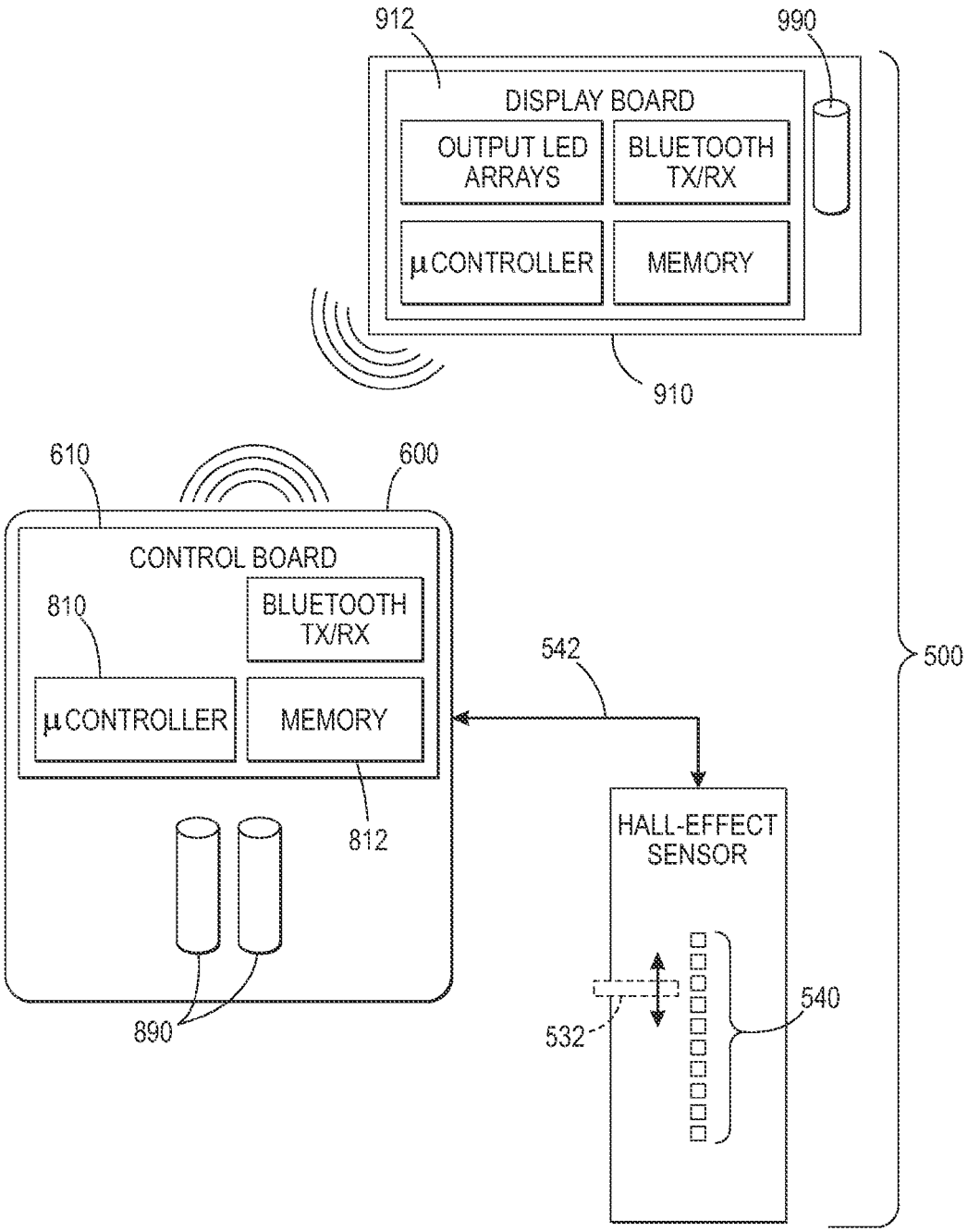
FIG. 10 is a schematic diagram of an embodiment of the sensor system.

Referring also to FIGS. 5 and 7-10, depicted therein is a sensing system 500 for monitoring at least the relative position between the scraping edge 116 and blade 101 to enable control of the down pressure applied to the scraping edge. As will be described in more detail below, the sensor is connected to and includes a visual indicator (FIG. 9) to display changes in the relative position between the blade and edge, in order to characterize the relative down-pressure being applied to the edge by the loader or vehicle forcing the edge downward while plowing. As illustrated in FIGS. 5 and 7, one part of sensing system 500 includes a telescoping assembly 510, attached to the rear of the material pusher, to sense the relative distance between the bottom longitudinal edge of the upstanding blade 101 and the scraping edge 116. The telescoping assembly 510 includes an outer shroud 520 having a pivot bushing 522 and hole 524 for attachment at a pivot point 503 on or near the blade edge. At the top of shroud 520 is a vent 518 for preventing creation of pressure to interfere with the travel of inner member 530. It will be appreciated that stops or travel limits may also be included in the assembly. The outer shroud is made of aluminum or other resilient, non-magnetic material. Inner member 530, formed from a low-friction, non-magnetic material such as a polymer (e.g., Nylon®), is designed to have outer dimensions slightly smaller than the inner dimensions of the shroud 520 in order to assure that the inner member slides within the shroud in the directions indicated by the arrow 528. Inner member 530 includes a permanent magnet 532 embedded near the top end of the member and a through-hole 534 at the bottom, for attachment of the inner member to a pivot point 504 on the rear of the scraping edge. As will be appreciated from FIG. 5, the pivot points for the shroud and inner telescoping member may be provided using brackets attached to the back of the blade and scraping edge along with bolts or pins, or other alternative methods for attachment that provide the necessary freedom of movement. Attached along an outer surface of shroud 520, in a position to detect the magnet 532, is a sensor circuit board 538 having a linear array of hall-effect sensors 540 (Part #US5781) suitable to sensing the presences of the permanent magnet 532 in close proximity to the sensor. Power is provided to the printed circuit board via cable 542, which also has wiring for return signals from the sensor. In use the circuit board and sensor array are protected by a cover 550 that encloses the entire region of the board.

The circuitry on the sensor circuit board 538 includes a voltage regulator 546 (e.g., TPS7A1633DGN), and a pair of general purpose parallel input/output (GPIO) devices 548 (e.g., PCA9555BS,118) providing an interface between the hall-effect sensors and a control board as described below. The GPIO devices operate to receive input from the sensors and convert the input to signals that are transmitted to the control board via cable 542, although it will be appreciated that a wireless communication technique may be employed if desired The control board 610, located in the sealable NEMA control module box 600, includes circuitry for the receipt of input signals from the hall-effect sensor array 540 as well as other inputs such as a GPS position and a tilt angle from an accelerometer 870 (e.g., LIS331HH from STMicroelectronics). Also provided is a long-life rechargeable battery pack 890 suitable for powering the control board for an extended period of time, and up to an entire season on a single charge, depending upon level of use. Operation of the control board is under the programmatic control of a microcontroller 810, such as the STMicroelectronics STM32F407ZGT6, which includes a CPU and on-board flash memory for associated control code as well as memory control for additional memory 812. The controller processes the incoming signals and produces outputs including the signal representations from the hall-effect sensor array. The signals are processed by the controller and provided to the operator of the vehicle to which the material pusher is attached.

In use, the relative position of the magnet 532 is detected by one or more hall-effect sensors in array 540 as the position changes due to changes in down-pressure on the material pusher blade. For example, when more downward pressure is applied to the scraping edge, the inner member 530 rises or is pushed inward relative to the outer shroud 520 and the magnet is sensed by one or more sensors in the array 540 above the prior position. Similarly, as the material pusher is raised, even to the point of being lifted off of a surface to be plowed, the sensor array responds by indicating that a sensor lower in the array is activated by the magnet as the inner member telescopes downward or outward from the shroud. By using the hall-effect sensor output, the relative position and thus the "down pressure" on the scraping edge can be characterized and displayed as will be described below relative to FIG. 9.

In one embodiment, in addition to providing sensing of the down pressure applied to the scraping edge of the material pusher, the sensor system 500 may include additional sensing capability. One additional sensor is a tilt sensor suitable for sensing the relative angle of the material pusher in at least a tilt forward-backward orientation, as illustrated for example in FIG. 3 (e.g., angle $\Theta$). The angle of the pushing apparatus is initially calibrated, based upon the position of the material pusher and the surface being plowed, by sensing the output of an accelerometer in each of the control module 600 and display module 910 and creating a calibration point. Subsequent changes in the angle $\Theta$ are then sensed by the accelerometers and a corresponding signal is produced to indicate the angle on a relative scale for display as will be discussed relative to FIG. 9. In one embodiment, the angle $\Theta$ is sensed using an accelerometer 870 (e.g., LIS331HH from STMicroelectronics). Furthermore, an accelerometer may also be employed to sense inertial events (such as starting of motion/movement), whereby the movement of the material pusher is also be monitored. For example, the inertial sensing output of the accelerometer is employed to trigger a timer upon initial movement, and the timer keeps running until there is no inertial change for a pre-defined period of time (e.g., five minutes). Data from the time of movement may be logged or recorded in the memory and in this way it is possible to monitor the operating time for the material pusher, as well as use such data to characterize plowing efficiency and other characteristics. The use of an interface such as a USB cable 904 or the like (FIG. 9) may be employed to access and retrieve such time data from the system as can the Bluetooth communication link as described below.

Another additional sensor that may be employed is a position sensor based upon the global positioning system (GPS) satellite signals. By incorporating a GPS sensing device on the control board it is also possible to track and monitor the manner in which the material pusher is used, and such information may be further employed to both characterize efficiency as well as to track the location of the material pusher much in the manner that such systems are currently employed in automotive applications.

Communication between the Control Board and the Display Board is achieved via a Bluetooth wireless communication facilitated by Bluetooth module 860 (e.g., SPBT2632C2A.AT2 from STMicroelectronics) present on both the control and display boards. It is possible for the same printed circuit board (e.g., a 2-sided board) to be used for both the display board 912 and the control board 610, where the components necessary for each board are populated depending upon the type of board desired. Both boards may also include a USB transceiver 850 (e.g., STULPI01BTBR from STMicroelectronics) permitting the devices to be accessed via a USB interconnection in order to provide programmatic updates and the optional download of stored usage data via USB cable interface 852 (e.g., Part No. 67503-1020) and cable 904.

In response to signals received from the control board via the Bluetooth interface, display board 912 produces at least a visual indication or representation of the information gathered and recorded by the control board. Display module 910 is mounted in the cab of the vehicle 140 that is used to drive the material pusher, and the operator can observe the module while plowing or otherwise using the material pusher. The module may include its own battery 990 and/or may include a power cord (not shown) for attachment to the vehicle power (e.g., standard 12V connection). Output light emitting diode (LED) arrays 920 are provided on the display board so that they may be seen through the front plate or cover 930 on display module 910. The LED arrays are selectively activated in response to signals received from the control board. For example, referring to the display face 930, there are several regions provided for visual display of information to an operator. In the DOWN PRESSURE region 940, there are a series of increasing-length LED arrays that are activated, left to right to indicate increased down pressure being applied to the scraping edge (i.e., decreasing distance between the blade and scraping edge). More specifically, as the hall-effect sensors detect that the permanent magnet has moved further into the shroud, the LED arrays are illuminated starting from the left side when there is little or no deflection of the scraping edge relative to the blade (e.g., when lifted or just touching the surface), and up to a point where all LEDs in region 940 are illuminated, indicating that the magnet is being detected by the next to uppermost hall-effect sensor(s) (when there is maximum downward pressure applied on the scraping edge). And, the uppermost sensor may be employed to cause a warning signal (e.g., an audible signal and/or flashing of all lights in region 940). As will be appreciated, it may also be possible to integrate the sensor system with the hydraulic controls for the vehicle (wired and/or wireless) such that the hydraulics controlling the bucket may be automatically adjusted to "hold" or control a particular aggressiveness for the scraping edge. Such a system may require analog or digital control circuitry as well as additional user adjustments.

The plow position or tilt display operates in a similar manner based upon the tilt angle information provided from the accelerometer 870. In region 950 of the display, one linear array of LED lights is illuminated at any particular time to indicate that the position of the material pusher is tilted down (forward), or up (backward) as it deviated from the optimal angle of the front edge of the side plate being vertical or generally perpendicular to the surface being plowed. Once again, as the angle of tilt changes relative to the surface being plowed, the display in region 950 is updated based upon signals exchanged with the control board. As noted above, the tilt angle may be "calibrated" based upon the orientation of the material pusher and the surface being plowed. Use of accelerometers in each of the control module 600 and display module 910, and intercommunication between the processors on each of the respective boards, permits a relative tilt angle to be determined for the material pushing apparatus itself by adjusting the accelerometer reading for the control module mounted on the pusher relative to the reading from the accelerometer mounted in the loader. Once both accelerometers are calibrated, the accelerometer mounted in the display module will output a signal indicative of the orientation of the surface being plowed and the tilt angle of the material pusher would then be relative to the surface. That way, the tilt angle at any particular time, once calibrated, is relative to the surface being plowed and is not an absolute angle. After the calibration process is completed, the tilt angle display then indicates changes in the orientation of the material pushing apparatus relative to the surface being plowed. Calibration mode for the sensing system is indicated by illumination of an LED at position 970. A similar display is also provided to indicate the detection of a low battery level at position 980. In one embodiment, low battery may be signaled when approximately ten percent of charge remains in the battery pack, although it will be appreciated that other low-battery thresholds may be predefined and adjusted programmatically.

It will be appreciated that variations of the afore-described improvements and modifications may be applied or adapted to operate in conjunction with or on other types of pushers and similar material moving or scraping apparatus, including but not limited to, fold-out pushers and other types of snow plows and blades. It will be further appreciated that variations of the above-disclosed coupling mechanisms and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A material pushing apparatus, comprising:

an upstanding central blade, including a longitudinal edge along a bottom side of said blade, and at least one removable side plate attached to an end of the central blade near and extending generally forward from the central blade;

a scraping edge flexibly attached to the central blade along the bottom longitudinal edge; and a position sensor for monitoring relative position between the scraping edge and central blade, and producing a position signal representing the relative position.

2. The material pushing apparatus according to claim 1, further comprising a tilt sensor for monitoring relative tilt angle of the central blade, and producing a tilt signal representing the relative tilt angle.

3. The material pushing apparatus according to claim 2, further including a visual indicator and a processor operating in accordance with a program stored in memory and associated with said processor, said processor receiving at least one of the position signal and the tilt signal as inputs and producing at least one output signal in response thereto, where a representation of the output signal is displayed on the visual indicator.

4. The material pushing apparatus according to claim 3, wherein said processor periodically updates the output signal in response to a change at least one of the position signal and the tilt signal resulting in a change in the visual indicator.

5. The material pushing apparatus according to claim 3, further including an audible indicator response to output from the processor.

6. The material pushing apparatus according to claim 3, wherein said processor and said visual indicator are in wireless communication.

7. The material pushing apparatus according to claim 3, further including a battery providing operating power for said processor and at least one of said tilt sensor and said position sensor, and wherein said processor processes a signal indicating remaining battery and produces an output to said visual indicator to indicate a low battery condition when the remaining battery life is below predefined level of remaining charge.

8. The material pushing apparatus according to claim 1, wherein said position sensor is pivotally mounted to said central blade, said position sensor includes a telescoping member operatively connected to said scraping edge, and an associated hall-effect sensor to sense the relative position of the telescoping member, wherein said hall-effect sensor senses a magnet affixed to said telescoping member.

9. The material pushing apparatus according to claim 2, wherein said tilt sensor includes an accelerometer.

10. The material pushing apparatus according to claim 9, further including a processor operating in accordance with a program stored in memory and associated with said processor, said processor receiving a signal from said accelerometer in response to the vibration of the pushing apparatus, and in response to said signal indicating vibration, the processor accumulating and storing in the memory at least one accumulated time of operation for said pushing apparatus.

11. The material pushing apparatus according to claim 1, wherein the at least one side plate includes a flexible skirting on the bottom thereof, said skirting being inwardly biased and held at the bottom edge of the side plate.

12. The material pushing apparatus according to claim 1, where the scraping edge includes both forward facing and rearward facing components that are angularly oriented relative to one another.

13. The material pushing apparatus according to claim 1, further including a coupler, flexibly attached to the rear of the central blade for attaching the pushing apparatus to a bucket of a vehicle for moving the pushing apparatus, said coupler including a plurality of C-shaped receivers, at least one of said receivers including upper and lower arms extending rearward relative to the central blade and forming a slot therebetween for receiving an edge of the bucket, wherein at least one of said arms further includes a cam having a high friction surface thereon for contacting a surface of the bucket when the bucket is placed in the slot, said cam thereby affixing the bucket to the coupler.

14. The material pushing apparatus according to claim 1, further including a pivotable wear shoe attached to and behind the central blade to provide a further ground contact surface behind the apparatus when in operation.

15. The material pushing apparatus according to claim 14, wherein the vertical position of the wear shoe, relative to the central blade, is adjustable.

16. A method for operating a material pushing apparatus, said apparatus comprising a material pushing apparatus, including an upstanding central blade, having a longitudinal edge along a bottom side of said blade, and at least one removable side plate attached to and extending generally forward from the central blade near an end thereof; a scraping edge flexibly attached to the central blade along the bottom longitudinal edge; a position sensor for monitoring relative position between the scraping edge and central blade, and producing a position signal representing the relative position; a tilt sensor for monitoring relative tilt angle of the central blade, and producing a tilt signal representing the relative tilt angle; a visual indicator; and a processor;

said processor operating in accordance with a program stored in memory associated with said processor, to periodically receive at least one of the position signal and the tilt signal as inputs and to update at least one output signal in response thereto, where a representation of the output signal is displayed on the visual indicator.

17. The method according to claim 16, wherein said position sensor comprises a telescoping member, and where the method further includes pivotally mounting the position sensor to the central blade, the position sensor including a telescoping member operatively connected to the scraping edge, and an associated hall-effect sensor to sense the relative position of the telescoping member, wherein the hall-effect sensor senses a magnet affixed to the telescoping member.

18. The method according to claim 16, wherein the tilt sensor includes an accelerometer and where the processor receives a signal from the accelerometer in response to vibration of the pushing apparatus, and in response to the signal indicating vibration, the processor accumulates and stores, in the memory, at least one accumulated time of operation for said pushing apparatus.

19. A material pushing apparatus, comprising:

an upstanding central blade, including a longitudinal edge along the bottom side of said blade, and left and right vertical side plates attached to and extending generally forward from or near each of the ends of the central blade, said side plates being bolted on and detachable from the blade, and including a flexible skirting on the bottom thereof, said skirting being inwardly biased and held at the bottom edge of the side plates;

a plurality of scraping edge segments flexibly attached to the central blade along the bottom longitudinal edge, where the scraping edge segments include both forward facing and rearward facing components that are angularly oriented and ends thereof are spaced apart;

a coupler flexibly attached to the rear of the blade for attaching the pushing apparatus to a bucket of a vehicle for moving the pushing apparatus, said coupler including a plurality of C-shaped receivers, at least one of said receivers including opposed upper and lower arms extending rearward relative to the central blade and forming a slot therebetween for receiving an edge of the bucket, wherein at least one of said arms further includes a pivotable cam having a high friction surface thereon for contacting a surface of the bucket when the bucket is placed in the slot, the cam thereby affixing the bucket to the coupler;

a sensor for monitoring the relative position between the scraping edge and blade, and including a visual indicator to reflect change in the relative position; and a pivotable wear shoe attached to and behind the central blade to provide a further ground contact surface behind the apparatus when in operation.

* * * * *